United States Patent [19]

Bates

[11] 4,407,501

[45] Oct. 4, 1983

[54] CURVED BALL COURT

[76] Inventor: Farrell C. Bates, 639 N. Vickers St., Thunder Bay, Ontario, Canada, P7C 4B6

[21] Appl. No.: 355,651

[22] Filed: Mar. 8, 1982

[30] Foreign Application Priority Data

Mar. 11, 1981 [CA] Canada ..... 372792

[51] Int. Cl.[3] ..... A63F 7/02

[52] U.S. Cl. ..... 273/118 R

[58] Field of Search ..... 273/118–125

[56] References Cited

U.S. PATENT DOCUMENTS 1,477,334 12/1923 Ewing ..... 273/123 R 1,599,188 9/1926 Seede ..... 273/119 R

FOREIGN PATENT DOCUMENTS 2438051 2/1975 Fed. Rep. of Germany ... 273/118 R 420169 11/1934 United Kingdom ..... 273/118 R

*Primary Examiner*—Paul E. Shapiro

*Attorney, Agent, or Firm*—Lawrence I. Field

[57] ABSTRACT

A curved ball court having a raised part extending from the front of the court towards the central region of the court, a concave playing surface at each side of the raised part, a vertical curved rear wall, the rear wall and the concave playing surfaces being connected by a parabolic curve.

5 Claims, 2 Drawing Figures

CURVED BALL COURT

This invention relates to a curved ball-court on which a game can be played by two people without the people moving from a set position.

BACKGROUND OF THE INVENTION

There are many ball games presently played by all ages of people these being ball games such as squash, tennis, hand ball and the like. All of these games have in common the fact that it is necessary for the players to move around on the court usually quite quickly in order to play the game. The playing of these games is therefore limited to persons who are completely mobile and any person having a disability associated with one of their legs is not able to play this type of ball game or is limited to playing a very poor game.

SUMMARY OF THE INVENTION

This invention relates to a ball court which is so shaped that two players can play a ball game without moving from a set position on the court. The court is arranged so that a ball hit from one side towards a curved end follows a path so that it arrives at the other side of the court passing close to the other player. Such a ball game can therefore be played without the players moving their feet and yet the thrill of playing a ball game and the exercise of playing the game will still be achievable.

In summary, the ball court of this invention is of a rounded shape having a somewhat rectangular plan view, one end of the court being flat and rising along a parabolic incline to a concave shape at the other end, the one end of the court having a raised central region and a concave side extending from a lower side edge up to the raised central region. A player stands at either side of the raised central region outside the edges of the court. A club somewhat similar to a golf club is used for propelling the ball from one end of the court up the parabolic incline to the opposite end and down to the other side of the court from whence it is returned by the other player.

In order to make the game more challenging, another embodiment of the court utilizes a mechanism on the raised central portion which holds two projecting rods which have a flattened portion at their end which is close to the curved court surface. The ends function as targets and as these targets slowly oscillate, the player hits a ball so that it will pass between the target and the wall and in doing so can be counted as a score in a game. A sensor is preferably associated with the target with signals being fed back through the oscillating rods to a score board so that every time a ball passes beneath a target a point will be recorded on the score board.

The invention will now be described with reference to the accompanying drawings in which

DETAILED DESCRIPTION OF PREFERRED EMBODIMENTS

Figure 1:
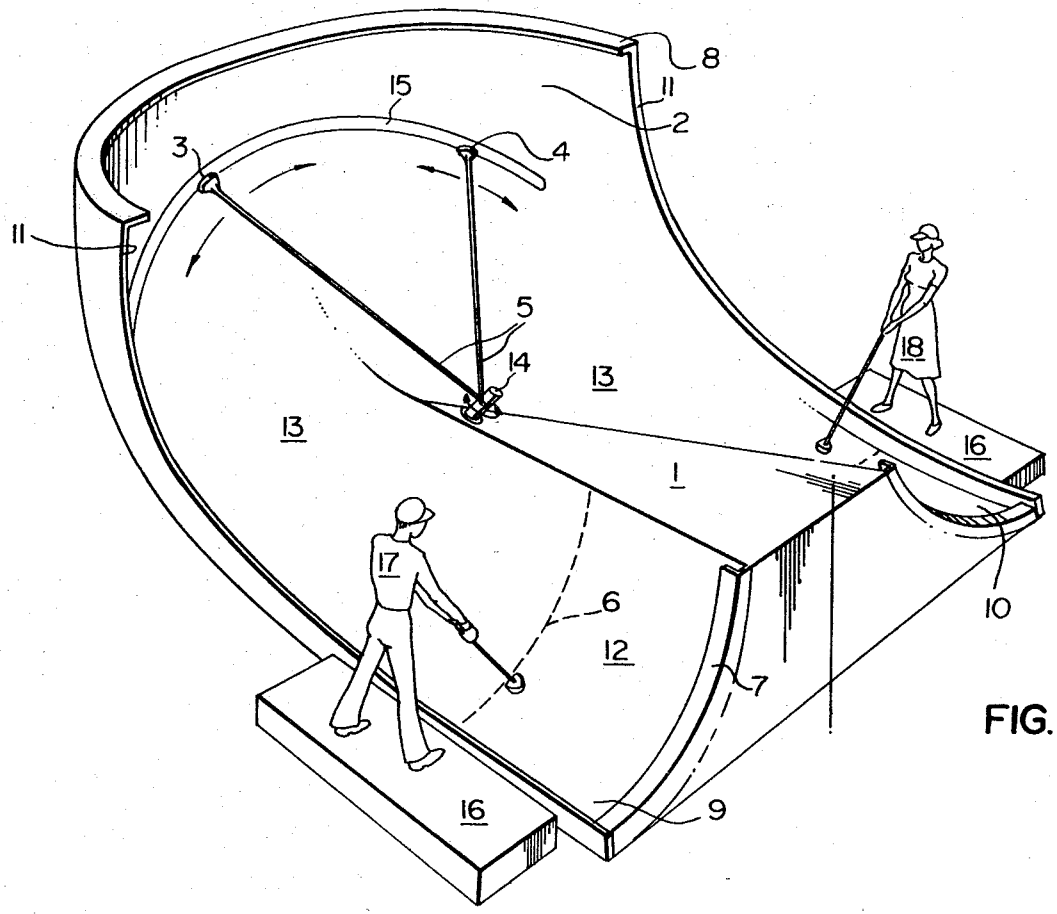
FIG. 1 is a perspective view of the ball court of this invention.
Figure 2:
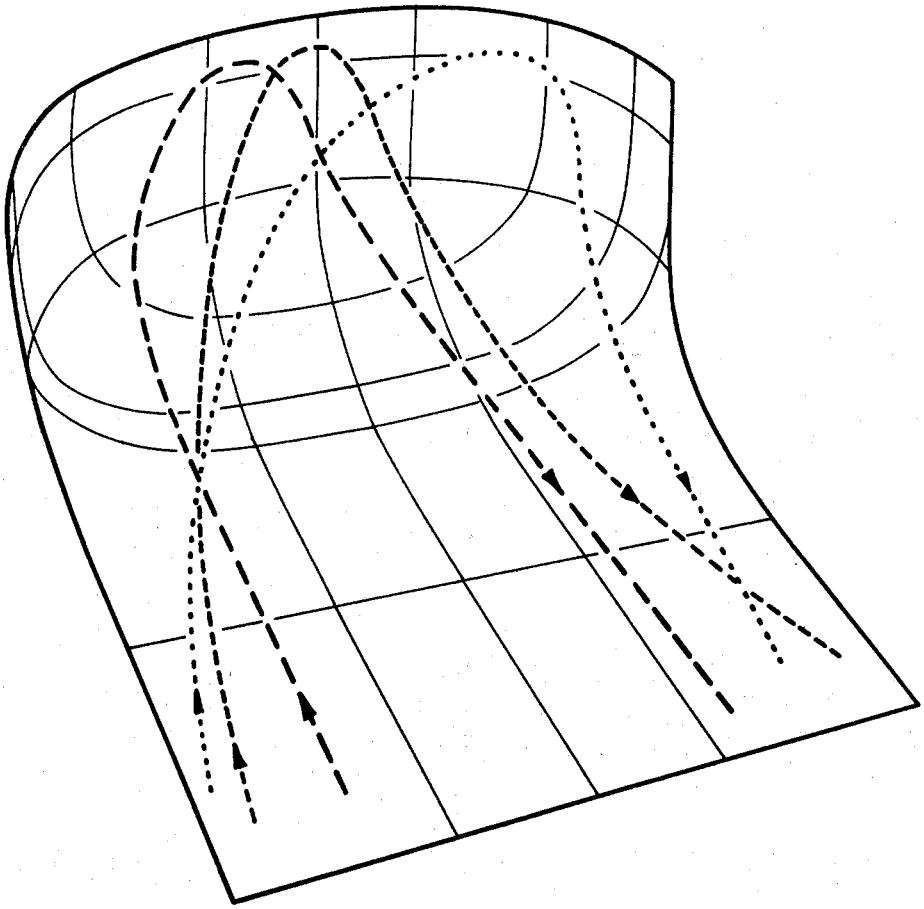
FIG. 2 is a diagrammatic view showing how a ball will travel on the court.

Referring to FIG. 1, the court consists of a raised portion 1 and a curved portion 2. The back of the court has a rim 8 extending inwardly to retain the ball and the edges 11 at the back of the court extend along the side of the court to the front and alter shape until they become vertical near the front of the court. Rims 7 are provided at the front of the court between the edges 11 and the central raised portion 1 to prevent a ball from leaving the front of the court. At the front of the court, the areas 12 on each side of the raised part 1 are of concave shape and the concave shape is progressively flattened towards the mid region 13 of the court and as such is widened and eventually joins where the raised portion 1 ends. The two concave parts 13 then eventually merge into the concave part 2 at the back of the court. The shape however from the front to the back of the court is somewhat parabolic and hence a hard hit ball from the front of the court will quickly slow down when it reaches the back of the court so that it will very rarely hit the rim 8 but will follow a natural curve. Three typical curves are shown in FIG. 2 and it will be noted that in all cases a ball hit on one side of the court, even if hit parallel to the edges of the court will naturally curve over towards the other side of the court and run back along the other side of the court to the other player due to this shape of court, it will therefore not be possible to have a ball hit from one side of the court return to that same side under its own momentum.

The court can be made from any suitable material such as wood planking plastic sheeting on a wooden framework, however it is preferential to build it of concrete formed upon a wooden framework. This latter construction is preferred as it is preferable that the court be placed outdoors.

Also shown in FIG. 1 is a shaft 14 which is positioned at the rear end of the raised part 1, this shaft being attached to any well known type of mechanism (not shown) underneath the court so that an oscillating movement of the shaft will be obtained. Two rods 5 are secured to and extend from shaft 14 and are fitted at their outer ends with targets 3 and 4. Each target is spaced from wall 2 by an amount which at least permits a ball to pass between the target and the wall. The path of the targets can be marked on the wall by for instance a painted band 15. A line 6 can also be drawn upon the court to provide a position from which to hit the ball and to assist the players in maintaining their orientation to the court. A platform 16 is also provided at each side of the court for the player to stand upon.

When playing the game with the targets 3 and 4 oscillating slowly across the court, when player 17 hits a ball so that it passes under target 3 a point will be scored, whereas when player 18 hits a ball under target 4 a point will be scored. When a player misses the ball and it is caught under rim 7, a point will be deducted from the player's score and added to the other player's score and the ball will return to the front lower corners of the court at positions 9 or 10.

In order to count the points obtained by a ball passing beneath a target, it is preferable that a sensing mechanism (not shown) be situated in each target 3 and 4 and signals fed along rods 5 to a score board (not shown) showing both player's scores. Such a sensing and scoring system will not be described in this application any type of well known system can be used and therefore does not form part of this invention.

I claim:

1. A curved ball court having a raised part extending from the front of the court towards the central region of the court, a concave playing surface at each side of the raised part, a vertical curved rear wall, the rear wall and the concave playing surfaces being connected by a parabolic curve.

2. The court of claim 1, wherein the concave playing surfaces are in a plane which is at right angles to the rear wall.

3. The court of claim 1, including a rim at the front of each concave playing surface and a rim at the top of the rear wall.

4. The court of claim 1, wherein the edges of the curved rear wall flow forwardly and become upstanding edges near the front of the court.

5. The court of claim 1 including an oscillatable shaft upstanding at the front of the raised part, with rods extending rearwardly from the shaft, and a target at the end of each rod which is spaced from the curved rear wall to permit a ball to pass between each target and rear wall.

* * * * *